United States Patent [19]

Foster

[11] 4,270,602

[45] Jun. 2, 1981

[54] HEAT EXCHANGER

[75] Inventor: Berry W. Foster, Redondo Beach, Fla.

[73] Assignee: The Garrett Corporation, Los Angeles, Calif.

[21] Appl. No.: 938,135

[22] Filed: Aug. 30, 1978

[51] Int. Cl.[3] ..... F28D 9/00

[52] U.S. Cl. ..... 165/167; 29/157.3 D; 165/170; 165/182

[58] Field of Search ..... 165/148, 165, 166, 167, 165/170, 182; 29/157.3 R, 157.4, 157.3 D

[56] References Cited

U.S. PATENT DOCUMENTS

| | | | |
|---|---|---|---|
| 1,823,788 | 9/1931 | Dewoitine | 165/170 |
| 1,826,344 | 10/1931 | Dalgllesh | 165/166 X |
| 2,285,998 | 6/1942 | Morrison et al. | 165/166 X |
| 2,321,110 | 6/1943 | Shipman | 165/166 X |
| 2,462,421 | 2/1949 | Pitt | 165/170 X |
| 2,620,169 | 12/1952 | Gross et al. | 165/166 X |
| 2,999,305 | 12/1961 | Reynolds | 165/165 X |
| 2,999,308 | 12/1961 | Pauls | 165/170 X |
| 3,469,626 | 9/1969 | Wright et al. | 165/166 |
| 3,887,664 | 6/1975 | Regehr | 165/166 X |
| 3,931,854 | 1/1976 | Ivakhnenko et al. | 165/166 |

*Primary Examiner*—Stephen Marcus

*Attorney, Agent, or Firm*—Stuart O. Lowry; Albert J. Miller

[57] ABSTRACT

A heat exchanger comprising a stacked array of formed plates each including semi-tubular channels with periodic recessed constrictions, and plate-supporting dimples. The plates are connected in inverted pairs to form tubular fluid flow channels, and the connected pairs of plates are stacked with the dimples received in the recessed constrictions of adjacent plates to form a rigid heat exchanger structure.

23 Claims, 6 Drawing Figures

HEAT EXCHANGER

BACKGROUND OF THE INVENTION

This invention relates to heat exchangers. Specifically, this invention relates to an improved formed plate heat exchanger construction.

Heat exchangers in general are well known in the prior art, and typically comprise a heat exchanger core having dual fluid flow paths for passage of two fluids in heat exchange relation with each other without intermixing. The fluid flow paths commonly comprise a plurality of relatively small and/or intricately shaped passages formed within a heat exchanger core so as to maximize the available core surface area for absorbing and transferring heat energy from one fluid to another.

In the prior-art, plate-type heat exchangers have become popular largely because of their simplicity of fabrication and ease of assembly. Such plate heat exchangers comprise a stacked array of relatively thin plates connected together in a spaced relationship so as to provide fluid flow regions between the plates. Extended surface fin elements commonly are interposed between the plates to form a multiplicity of relatively small fluid flow paths within the flow regions, and to increase the available surface area for absorbing and transferring heat energy. Suitable manifolds supply the two fluids to the heat exchanger for flow through the flow paths in the core without intermixing.

Plate-type heat exchangers of the prior art typically display certain disadvantages which limit their utility to relatively high technology applications. In particular, these heat exchangers require a variety of parts such as plates, fins, headers, and the like which must be carefully and accurately positioned and secured together for proper operation of the heat exchanger. See, for example, U.S. Pat. No. 2,804,284. Moreover, the plate materials are desirably thin to form a lightweight heat exchanger core with maximum heat transfer between fluids. However, the use of lightweight plates is limited by the capacity of the assembled core to endure mechanical shear loads and thermal cycling stresses without collapsing, stress failure, etc. See, for example, U.S. Pat. Nos. 1,914,077, 2,375,702, 3,463,222, 3,661,203 and 3,705,618.

The heat exchanger of this invention overcomes the problems and disadvantages of the prior art by providing an improved plate-type heat exchanger formed from a minimum number of parts, and including interfitting formed plates providing a rigid heat exchanger construction of three dimensional stability.

SUMMARY OF THE INVENTION

In accordance with the invention, a heat exchanger comprises a plurality of substantially identical formed plates each including spaced rows of semi-tubular channels. The channels include periodic recessed constrictions forming outwardly presented semi-annular recesses spaced along the lengths of said channels. The formed plates are connected together in inverted pairs to form rows of tubular fluid flow paths, with the constrictions varying the rate of fluid flow through said paths along the lengths of the plates.

The connected pairs of plates are arranged in a stacked array to form a heat exchanger core. Each of the formed plates includes a plurality of plate-supporting depressed dimples positioned for seating into the semi-annular constriction recesses of adjacent plates in the stack to form a heat exchanger core rigid in three dimensions and resistant to shear loading. The dimples also serve to space the connected pairs of plates from each other to form fluid flow paths in close heat exchange relation with the tubular paths for transfer of heat energy therebetween.

BRIEF DESCRIPTION OF THE DRAWINGS

The accompanying drawings illustrate the invention. In such drawings.

DETAILED DESCRIPTION OF THE PREFERRED EMBODIMENT

Figure 1:
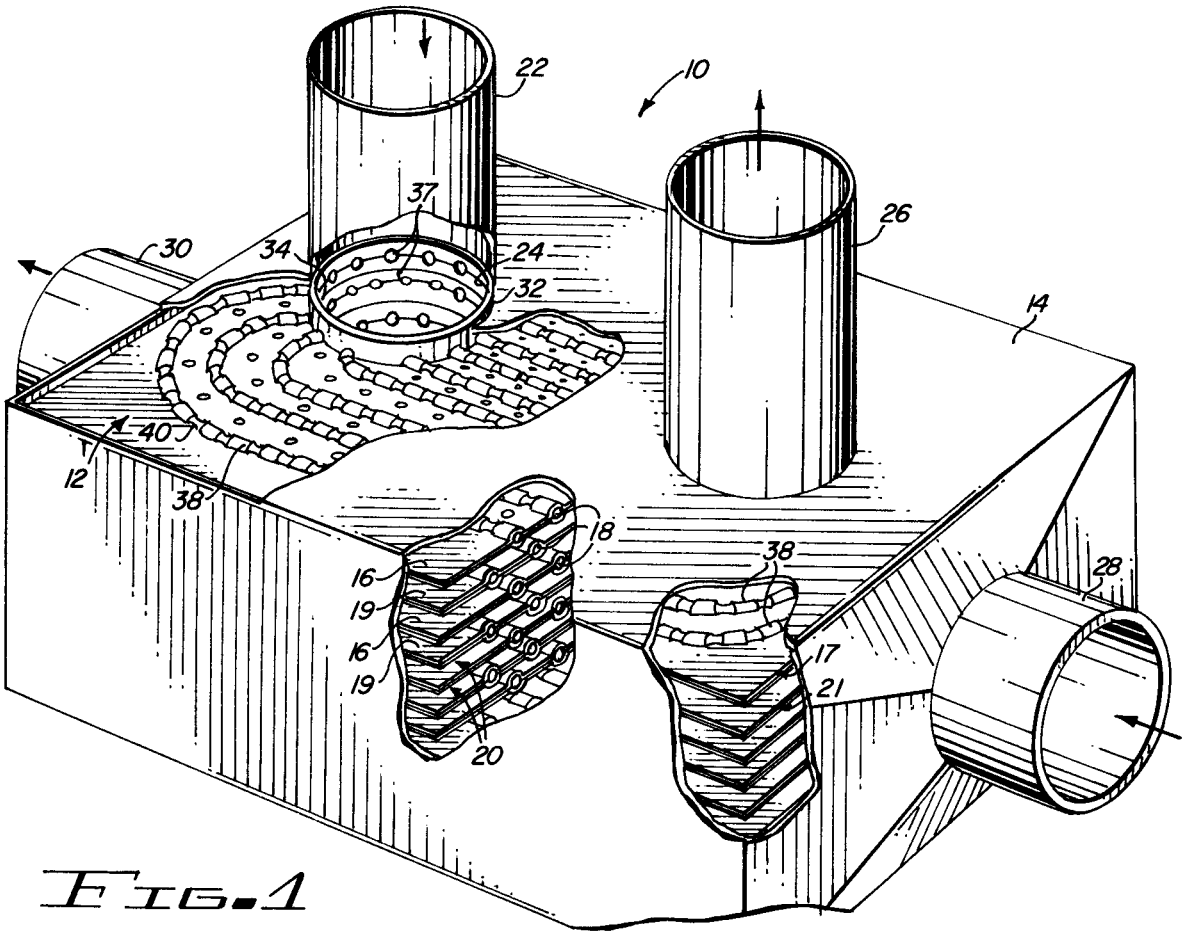
FIG. 1 comprises a perspective view of a heat exchanger of this invention, with portions broken away.
Figure 2:
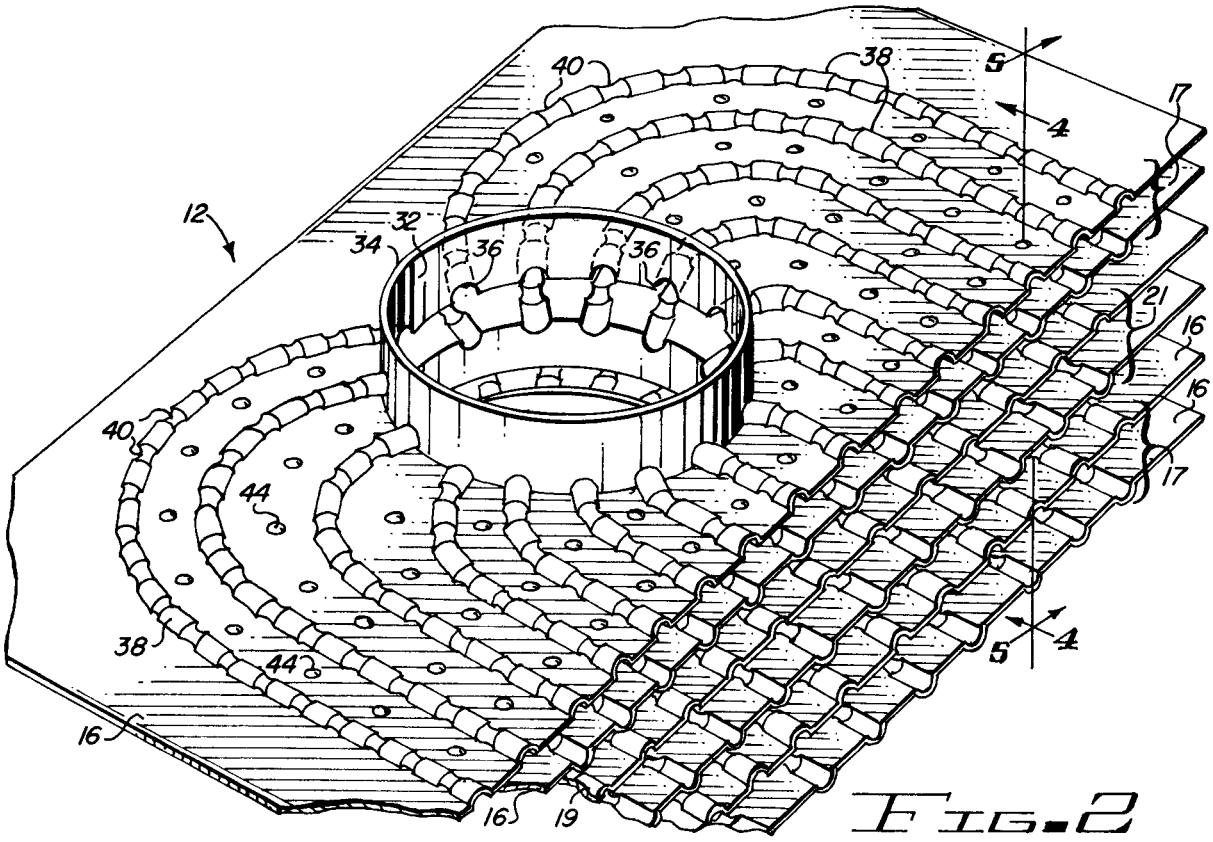
FIG. 2 comprises an enlarged fragmented exploded perspective view of a portion of the heat exchanger.

A heat exchanger 10 of this invention is shown generally in FIG. 1, and comprises a heat exchanger core 12 carried within a housing 14. As shown, the heat exchanger core 12 comprises a stacked array of generally planar plates 16 and 19 forming dual fluid flow paths for passage of two fluids in close heat exchange relation with each other. More specifically, the plates 16 and 19 are arranged to form a plurality of elongated tubular channels 18 comprising a first fluid flow path for passage of a first fluid such as a heated gas or liquid. The tubular channels 18 are arranged in close heat exchange relation with a second fluid, such as air, flowing through relatively open flow regions 20 comprising a second flow path between the plates 16 and 19. Conveniently, the first fluid is supplied to the tubular passages 18 via an inlet conduit 22 coupled to a cylindrical inlet manifold riser 24, and is carried from the heat exchanger as by an outlet conduit 26 communicating with a suitable outlet manifold riser (not shown). Similarly, the second fluid is supplied to the heat exchanger 10 as by an inlet duct 28, and is exhausted from the heat exchanger as by an outlet duct 30 at the opposite end of the heat exchanger.

The plates 16 and 19 forming the heat exchanger core 12 are shown in more detail in FIGS. 2–5. As shown, each of the plates 16 and 19 is formed from a suitable sheet of metal, ceramic, or the like, and comprises a generally rectangular configuration adapted to fit inside the housing 14 of the heat exchanger 10. Each of the plates 16 and 19 includes a circular opening 32 near one end thereof (FIG. 2) comprising a portion of the cylindrical inlet manifold riser 24. Similarly, the plates 16 and 19 each include a second opening (not shown) near the opposite end thereof for alignment with the outlet conduit 26, and forming a portion of the outlet manifold riser. However, since the openings and the manifold risers are identical in construction, only the inlet manifold ends of the plates 16 and 19 are shown in detail in the drawings.

The inlet openings 32 of the plates 16 and 19 are bounded by a circular flange 34 projecting from the general plane of the associated plate. The flange 34 includes at its lower end a plurality of equiangularly spaced semi-circular openings 36 which are aligned with and form a part of a plurality of semi-tubular channels 38 formed within each of the plates 16 and 19. The channels 38 radiate outwardly from the flange 34, and then turn arcuately for longitudinal passage along the lengths of the plates 16 and 19. Then, as illustrated in FIG. 1, the semi-tubular channels 38 turn arcuately for inward radiation toward the outlet manifold riser (not shown) and the outlet conduit 26.

The semi-tubular channels 38 of the plates include periodic recessed constrictions 40 along the lengths of said channels. These constrictions 40 serve to reduce the cross-sectional passage area of the semi-tubular channels 38 at regular intervals, and to form outwardly presented semi-annular recesses. Moreover, the plates 16 and 19 each include a pluarlity of depressed dimples 44 which project from the general plane of the plates in the same direction as the flange 34 and the semi-tubular channels 38. These dimples 44 are formed in rows staggered between the spaced rows of semi-tubular channels 38, and are positioned at predetermined points for mating reception within the semi-annular recessed constriction 40 of an adjacent plate, as will be hereafter described in more detail.

The plates 16 and 19 are assembled in inverted pairs 17 and 21, respectively, as by brazing or welding, with their semi-tubular channels 38 aligned with each other. More specifically, the plates 16 are all identical and are connected together in inverted pairs to form the flow channels 18. The other plates 19 are also identical, and differ from the plates 16 only in that their rows of semi-tubular channels 38 are offset or staggered with respect to the corresponding channels of the plates 16. These plates 19 thus, when connected together in inverted pairs, form additional tubular flow channels 18. Conveniently, the semi-circular passages 36 of the flanges 34 of the connected plate pairs 17 and 21 also align with each other to form circular entry openings 37 for admission of the first fluid from the inlet manifold riser 24 to the tubular flow channels 18, as illustrated in FIG. 1. The fluid thus is circulated from the inlet riser 24 through the tubular paths 18 to the outlet riser (not shown) which is identical in construction to the inlet riser 24, with the constrictions 40 forming periodic tubular constrictions serving to vary the fluid flow rate through each of the tubular paths 18 for increased heat transfer between the fluids and the plates.

Figure 3:
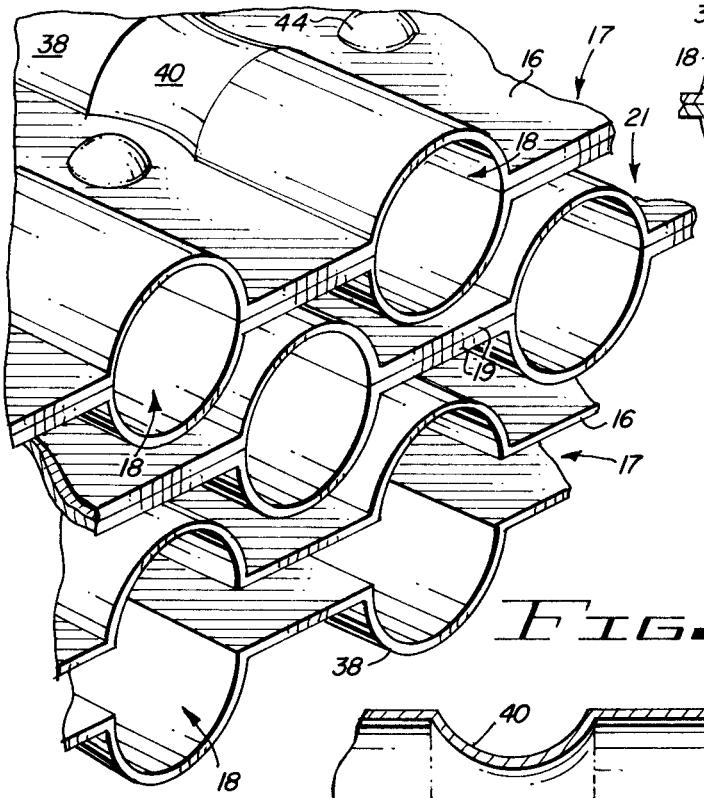
FIG. 3 comprises an enlarged fragmented perspective view, partially exploded, illustrating assembly of the heat exchanger.
Figure 4:
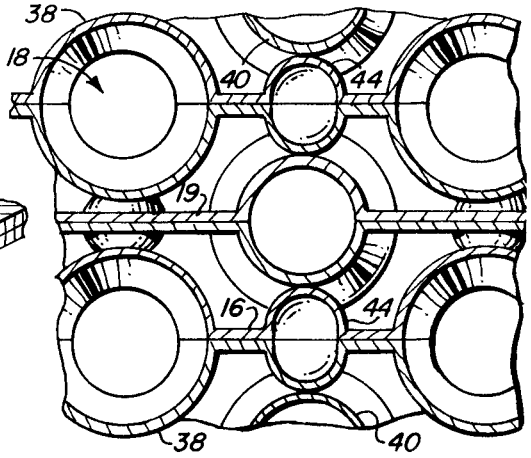
FIG. 4 comprises an enlarged fragmented elevation taken on the line 4—4 of FIG. 2.
Figure 5:
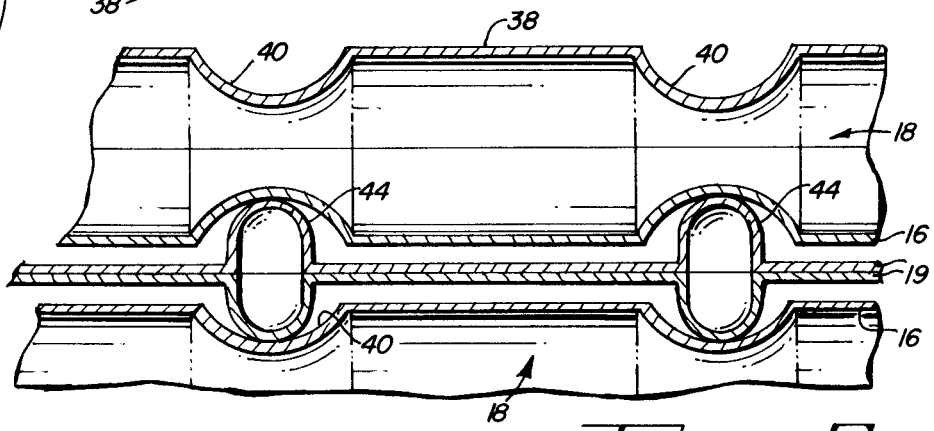
FIG. 5 comprises an enlarged fragmented elevation taken on a line 5—5 of FIG. 2.

The connected pairs 17 and 21 of plates 16 and 19 are arranged in an alternating stack with their respective flanges 34 sealingly secured together as by brazing or welding in mating and alternating vertical alignment to form the cylindrical inlet manifold riser 24 and the outlet manifold riser (not shown), and thereby isolate the inlet and outlet ends of the tubular passages 18 from the open flow regions 20. The assembled stack of plate pairs 16 and 19 forms the heat exchanger core 12 including spaced rows of the tubular flow channels 18. Because of the offset relationship between the plates 16 and 19, these spaced rows of channels 18 are offset or staggered with respect to each other as shown in FIGS. 3 and 4. Importantly, this staggered arrangement aligns the dimples 44 of each connected plate pair 17 and 21 for supportive reception within the semi-annular recessed constrictions 40 of adjacent plates in the stack. The dimples 44 are suitably secured in position as by brazing or welding to provide a plurality of support points between each connected plate pair 17 and 21 in the stack. These support points are regularly located over the length, width, and depth of the heat exchanger core 12 to provide a rigid heat exchanger core capable of withstanding relatively high shear loads and/or thermal cycling stresses.

Figure 6:
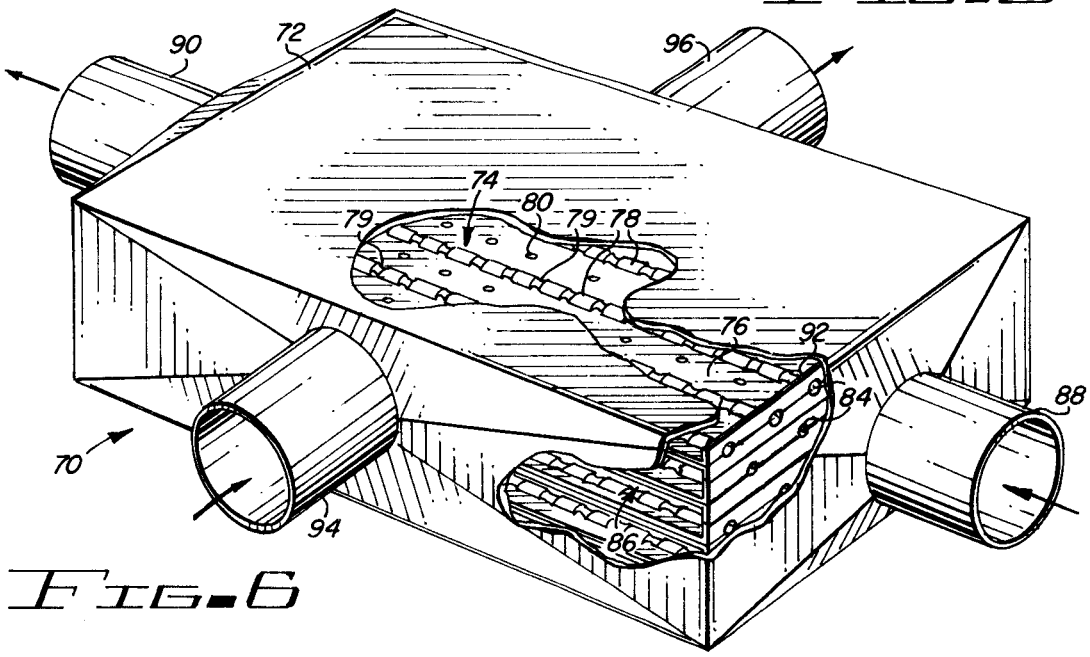
FIG. 6 comprises an enlarged perspective view of an alternate embodiment of the invention, with portions broken away.

A modified embodiment of the invention is shown in FIG. 6, and comprises a heat exchanger 70 including a housing 72 carrying a core 74. The core 74 is formed from a plurality of stacked plates each including spaced rows of semi-tubular channels 78 with periodic recessed constrictions 79, and rows of depressed dimples 80. The plates 76 are connected in inverted pairs with their semi-tubular channels 78 aligned to form tubular flow channels 84 for passage of a first fluid. The connected pairs of the plates 76 are arranged in stacked relation with each connected pair turned 180 degrees in the horizontal plane with respect to adjacent connected pairs to position their tubular flow channels 84 in staggered or offset rows. In this manner, the dimples 80 of each plate 76 are received in the recessed constrictions 79 of an adjacent plate to define relatively open flow regions 86 between connected pairs of the plates, and to provide a plurality of support points between the plates to form a three dimensionally rigid heat exchanger core.

In this embodiment, the plates 76 are all identical to each other, thereby further minimizing the number of different parts required for formation of the heat exchanger. The assembled heat exchanger core 74 is received in the housing 72, and a first fluid such as a heated gas or liquid is supplied to and exhausted from the core 74 by inlet and outlet conduits 88 and 90, respectively. More specifically, the inlet conduit 88 supplies the first fluid to an inlet end of the core 74 for passage through the tubular flow channels 84 comprising the first fluid flow path, and exhaustion therefrom via the outlet conduit 90 and the outlet end of the core. Importantly, the opposite ends of the plates 76 are turned to form mating flanges 92 which may be brazed or welded together and suitably sealed to the housing about the periphery of the ends of the core 74, to isolate flow of the first fluid to flow through the tubular channels 84, and thereby prevent first fluid flow through the open flow regions 86. A second fluid such as air is manifolded for flow through the open flow regions 86 as by inlet and outlet ducts 94 and 96 for passage in close heat exchange relation with the first fluid in the tubular flow channels 84.

A variety of modifications and improvements to the invention are believed to be within the skill of the art in view of the foregoing specification. For example, while the embodiment of the FIGS. 1–5 comprises a counterflow heat exchanger, and the embodiment of FIG. 6 comprises a cross-flow heat exchanger, it is not intended to limit either these or other embodiments to any specific flow configuration. Accordingly, the embodiments disclosed herein are not intended to limit the invention except by way of the appended claims.

What is claimed is:

1. A heat exchanger comprising a plurality of plates each including spaced rows of semi-tubular channels with periodic recessed constrictions, said plates being connected in inverted pairs with their semi-tubular channels aligned to form tubular channels defining a first flow path for a first fluid; and a plurality of depressed dimples on each of said plates, said connected pairs of plates being arranged in stacked relation with said dimples on each plate supportively received within aligned ones of the recessed constrictions of an adjacent plate to space the connected pairs of plates from each other to form relatively open flow regions between said connected pairs of plates defining a second flow path for a second fluid.

2. A heat exchanger as set forth in claim 1 including means for manifolding the first and second fluids for respective flow through said first and second flow paths.

3. A heat exchanger as set forth in claim 1 wherein said dimples are formed in rows between said rows of semi-tubular channels, and said connected pairs of plates are arranged in stacked relation with the tubular channels formed by each connected pair of plates staggered between the tubular channels of adjacent connected pairs of plates.

4. A heat exchanger as set forth in claim 1 wherein said recessed constrictions are positioned to form tubular constrictions when said plates are connected in inverted pairs.

5. A heat exchanger as set forth in claim 1 wherein said plates are identical to each other.

6. A heat exchanger as set forth in claim 1 wherein said dimples are connected to an adjacent plate within aligned ones of said constrictions.

7. A heat exchanger as set forth in claim 1 wherein said connected pairs of plates arranged in stacked relation are received within a substantially closed housing, and including means for manifolding the first and second fluids into and through said housing for respective flow through said first and second flow paths.

8. A heat exchanger as set forth in claim 7 wherein the tubular channels formed by said connected pairs of plates include inlet and outlet ends, said plates including flanges at the inlet and outlet ends of said channels, said flanges being aligned with each other and sealingly connected together in stacked relation to isolate said inlet and outlet ends from said second flow path.

9. A heat exchanger as set forth in claim 1 wherein said plates comprise a plurality of first plates each having semi-tubular channels with periodic constrictions and depressed dimples, and a plurality of second plates each having semi-tubular channels with periodic constrictions and depressed dimples offset with respect to said first plates, said first plates and second plates being connected in respective inverted pairs, and said connected pairs of first plates and second plates being arranged in an alternating stack.

10. A heat exchanger as set forth in claim 9 wherein the tubular channels formed by said connected pairs of first plates and second plates include inlet and outlet ends, said first and second plates including aligned flanges at the inlet and outlet ends of said channels, said flanges being sealingly connected in stacked relation to isolate said inlet and outlet ends from said second flow path.

11. A heat exchanger comprising a pluarlity of generally planar plates each including spaced rows of semi-tubular channels with periodic recessed constrictions and having inlet and outlet ends, said plates being connected in inverted pairs with their semi-tubular channels aligned to form tubular channels defining a first flow path for a first fluid; a plurality of dimples on each of said plates projecting from the general plane thereof in the same direction as said semi-tubular channels, said connected pairs of plates being arranged in stacked relation with said dimples of each plate supportively received within aligned ones of the recessed constrictions of an adjacent plate to space the connected pairs of plates from each other to form relatively open flow regions between said pairs of plates defining a second flow path for a second fluid; and flanges on said plates at the inlet and outlet ends of said channels, said flanges being connected in stacked alignment to isolate said inlet and outlet ends from the second flow path.

12. A heat exchanger as set forth in claim 11 wherein the periodic constrictions on said semi-tubular channels are aligned to form tubular constrictions when said plates are connected in inverted pairs.

13. A heat exchanger comprising a plurality of first and second plates each having spaced rows of semi-tubular channels with periodic recessed constrictions and having inlet and outlet ends, and a plurality of depressed dimples between said rows of semi-tubular channels, said semi-tubular channels and dimples of said second plates being offset with respect to said first plates, said first and second plates being connected together in respective inverted pairs with the semi-tubular channels of each connected pair aligned to form tubular channels defining a first flow path for a first fluid, said connected pairs of first plates being arranged in an alternating stack with said connected pairs of second plates with said dimples of each plate being supportively received within aligned ones of the recessed constrictions of an adjacent plate to space the connected pairs of first and second plates from each other to form relatively open flow regions defining a second flow path for a second fluid; and flanges on said first and second plates at said inlet and outlet ends, said flanges being connected in stacked alignment to isolate said inlet and outlet ends from the second flow path.

14. A method of forming a heat exchanger comprising the steps of forming a plurality of plates to have spaced rows of semi-tubular channels; forming a plurality of recessed constrictions along the lengths of said semi-tubular channels; forming a plurality of depressed dimples on said plates between the rows of semi-tubular channels; connecting the plates in inverted pairs with their semi-tubular channels aligned to form tubular channels defining a first flow path for a first fluid; and arranging said connected pairs of plates in stacked relation with the dimples of each plate supportively received within aligned ones of the recessed constrictions of an adjacent plate to space the connected pairs of plates from each other to form relatively open flow regions defining a second flow path for a second fluid.

15. The method of claim 14 including the step of forming the dimples in rows between the semi-tubular channels.

16. The method of claim 14 including the step of arranging the connected pairs of plates in stacked relation with the tubular channels of each connected pair of plates staggered between the tubular channels of adjacent pairs of plates.

17. The method of claim 14 including the step of connecting said dimples within said recessed constrictions.

18. The method of claim 14 including the step of forming the recessed constrictions in alignment to form tubular constrictions when the plates are connected in inverted pairs.

19. The method of claim 14 wherein said tubular channels have inlet and outlet ends, and including the steps of forming flanges on said plates at the inlet and outlet ends; and connecting said flanges in stacked alignment to isolate the inlet and outlet ends from the second flow path.

20. The method of claim 14 or 19 wherein said step of forming said plates comprises the steps of forming first and second plates to have spaced rows of semi-tubular channels, recessed constrictions, and depressed dimples, said second plates having their semi-tubular channels formed in offset relation with respect to said first plates; connecting said first plates and second plates in respective inverted pairs; and arranging said connected pairs of first plates in an alternating stack with said connected pairs of second plates.

21. A method of forming a heat exchanger comprising the steps of forming a plurality of generally planar plates to have spaced rows of semi-tubular channels having inlet and outlet ends; forming a plurality of dimples on each plate projecting from the general plane thereof in the same direction as the semi-tubular channels; forming a plurality of recessed constrictions along the lengths of said semi-tubular channels; connecting the plates in inverted pairs with their semi-tubular channels aligned to form tubular channels defining a first flow path for a first fluid; arranging said connecting pairs of plates in stacked relation with the dimples of each plate supportively received within aligned ones of the recessed constrictions of an adjacent plate to space the connected pairs of plates from each other to form relatively open flow regions defining a second flow path for a second fluid; forming flanges on said plates at the inlet and outlet ends of said channels; and connecting said flanges in stacked alignment to isolate said inlet and outlet ends from the second flow path.

22. The method of claim 21 including the step of forming the recessed constrictions in alignment to form tubular constrictions when the plates are connected in inverted pairs.

23. A method of forming a heat exchanger comprising the steps of forming first and second plates to have spaced rows of semi-tubular channels with periodic recessed constrictions, and depressed dimples, said second plates having their semi-tubular channels formed in offset relation with respect to said first plates; connecting said first plates and said second plates in respective inverted pairs with their semi-tubular channels aligned to form tubular channels defining a first flow path for a first fluid; and arranging said connected pairs of first plates in an alternating stack with said connected pairs of second plates with the dimples of each plate supportively received within aligned ones of the recesses of an adjacent plate to space the connected pairs of plates from each other to form relatively open flow regions defining a second flow path for a second fluid.

* * * * *